US009279589B2

(12) United States Patent
Lau et al.

(10) Patent No.: US 9,279,589 B2
(45) Date of Patent: Mar. 8, 2016

(54) DOOR LATCH SYSTEM AND METHOD

(75) Inventors: George Hon Kwong Lau, Delta (CA); Edwin Wayne Thurber, Surrey (CA)

(73) Assignee: FPI Fireplace Products International Ltd., Delta, British Columbia (CA)

( * ) Notice: Subject to any disclaimer, the term of this patent is extended or adjusted under 35 U.S.C. 154(b) by 472 days.

(21) Appl. No.: 13/115,504

(22) Filed: May 25, 2011

(65) Prior Publication Data

US 2011/0289853 A1 Dec. 1, 2011

Related U.S. Application Data

(60) Provisional application No. 61/349,640, filed on May 28, 2010.

(51) Int. Cl.

| | |
|---|---|
| ***E05C 3/06*** | (2006.01) |
| ***F24B 13/00*** | (2006.01) |
| ***E05B 3/00*** | (2006.01) |
| ***E05B 15/02*** | (2006.01) |
| ***E05C 3/04*** | (2006.01) |
| *E05C 3/00* | (2006.01) |

(52) U.S. Cl.

CPC ..... *F24B 13/004* (2013.01); *E05B 3/00* (2013.01); *E05B 15/022* (2013.01); *E05B 15/0295* (2013.01); *E05C 3/047* (2013.01); *Y10S 292/27* (2013.01); *Y10T 292/57* (2015.04)

(58) Field of Classification Search

CPC ..... E05C 3/00; E05C 3/04; E05C 3/047; E05B 15/022; E05B 15/0295; Y10S 292/27; F24B 13/004

USPC ..... 292/200, 240, 241, 340–341.19, 292/DIG. 27, DIG. 31, DIG. 73; 16/436

See application file for complete search history.

(56) References Cited

U.S. PATENT DOCUMENTS

| | | | | | |
|---|---|---|---|---|---|
| 927,240 | A | * | 7/1909 | Hoffman | 292/78 |
| 2,767,008 | A | * | 10/1956 | Oswald | 292/241 |
| 2,811,380 | A | * | 10/1957 | Osner et al. | 292/101 |
| 3,560,038 | A | * | 2/1971 | Gunther | 292/241 |
| 3,958,821 | A | * | 5/1976 | Scalera | 292/97 |
| 4,230,350 | A | * | 10/1980 | Gee et al. | 292/144 |
| 4,383,599 | A | * | 5/1983 | Maxwell | 194/350 |
| 4,389,930 | A | * | 6/1983 | Rutschilling | 100/88 |
| 4,674,777 | A | * | 6/1987 | Guelck | 292/101 |
| 4,691,952 | A | * | 9/1987 | Harmon | 292/341.18 |
| 5,313,738 | A | * | 5/1994 | Thakur et al. | 49/394 |
| 6,139,074 | A | * | 10/2000 | Barnett et al. | 292/240 |

(Continued)

FOREIGN PATENT DOCUMENTS

| | | | | | |
|---|---|---|---|---|---|
| AT | DE 29603234 | U1 | * | 4/1996 | F24B 13/004 |
| DE | 9216925 | U1 | * | 6/1993 | E05B 13/005 |

(Continued)

*Primary Examiner* — Carlos Lugo

(74) *Attorney, Agent, or Firm* — Snell & Wilmer LLP

(57) ABSTRACT

A door latch system for a heating system is provided. The door latch system may be installed with a fireplace, wood stove, pellet stove, or other suitable system. The door latch system comprises a handle, a handle head and a catch. The handle head may be configured to engage the catch. Moreover, the catch may be configured with a self adjusting tension system, such that when the handle head engages the catch, the catch is configured to exert a tension force on the handle head. This tension force also causes the handle head to compress the seal of a fireplace door where the door latch system is installed.

19 Claims, 12 Drawing Sheets

(56) References Cited

U.S. PATENT DOCUMENTS

| | | | | |
|---|---|---|---|---|
| 7,311,339 | B2 * | 12/2007 | Lau et al. | 292/128 |
| 7,416,228 | B2 * | 8/2008 | Pfitzinger et al. | 292/216 |
| 7,611,174 | B2 * | 11/2009 | Lau et al. | 292/341.15 |
| 7,780,208 | B2 * | 8/2010 | Koppenhoehl et al. | 292/340 |
| 8,136,195 | B2 * | 3/2012 | Michelson | 15/143.1 |
| 2009/0160201 | A1 * | 6/2009 | Dold et al. | 292/341.15 |

FOREIGN PATENT DOCUMENTS

| | | | | |
|---|---|---|---|---|
| DE | 29612452 | U1 * | 9/1996 | F24B 13/004 |
| JP | 02279884 | A * | 11/1990 | E05C 17/50 |

* cited by examiner

DOOR LATCH SYSTEM AND METHOD

CROSS REFERENCE TO RELATED APPLICATIONS

This application is a non-provisional application of, and claims priority to and the benefit of, U.S. Provisional Application Ser. No. 61/349,640 filed May 28, 2010 and entitled "Door Latch System and Method," which is hereby incorporated by reference.

FIELD OF INVENTION

The present disclosure relates to fireplace door latch systems and methods, and more particularly, relates to a door latch system and method that provides additional leverage for substantially sealing a fireplace door.

BACKGROUND OF THE INVENTION

Heating systems, and more specifically fireplaces, wood stoves and the like have been designed to burn more efficiently and provide greater heat output. The systems have employed doors to provide more efficient combustion environments. The doors are equipped with handles that allow for the doors to be operated in order to add fuel, clean the firebox, or otherwise access the firebox. Generally, these handles are fixedly attached the firebox door. They are also made of materials that are resistant to thermal stress, but typically conduct thermal loads. As such, the handle can become very hot and there is an increased risk of a user being burned while operating the door. Moreover, in order for the handle to provide sufficient force to operate the door, the handles are often large and visually unappealing. As such, there is a need to provide a fireplace door handle system that can stay cool when not being used and can provide sufficient force to operate the door.

SUMMARY OF THE INVENTION

In accordance with various aspects of the present invention, door latch system and method for providing sufficient closure force and one or more other appealing aspects are provided. In an exemplary embodiment, a door latch system for an appliance and/or heating system comprises a handle, a handle head and a catch. The handle may removably couple to the handle head in at least two orientations. The handle may be configured with a curved outer surface, with finger contouring, and/or other ergonomic features. Moreover, the handle may be removable, such that the handle can be stored away from a heating system. The handle head may also be configured to engage the catch. Moreover, the catch may be configured with a self adjusting tension system, such that when the handle head engages the catch, the catch exerts a tension force on the handle head. This tension force also causes the handle head to compress the seal of a fireplace door.

The tension system may comprise a spring or flexible bushing and one or more spacers. The spring force may be adjustable based on the number of spacer installed in the tensioning system. Moreover, the spacers may be added or removed to adjust the compression force exerted on the seal of a fireplace door. The ability to adjust the compression force allows the fireplace to continue to operate efficiently overtime, even as the seal wears.

In another exemplary embodiment, a fireplace comprises a door, a handle, and an engagement. The engagement may be removably coupled to the handle such that the handle may be coupled to the engagement in a first orientation and a second orientation. The fireplace may also comprise a catch mechanism coupled to the door. The catch mechanism may comprise a first tensioner and a first tensioner adjustment mechanism. The tensioner may be a spring, flexible bushing, or any other mechanism suitably configured to create a tension force. The engagement may have a C shape or a U shape. The engagement may be configured to operatively engage the catch mechanism in response to a first torque applied to the handle in a first orientation. Moreover, the engagement may be configured to operatively engage the catch mechanism in response to a second torque applied to the handle in a second orientation.

In another embodiment, a fireplace comprising a fireplace door including a door seal and a door latch system, a self-tensioning catch may be configured to be closed and sealed by the door latch system and self-tensioning catch. The handle may be removable such that it can be positioned in a first orientation and a second orientation. By applying a first rotational movement to the handle in the first orientation, the rotational movement causes a first torque to be exerted on the handle head, and, in response to the torque the handle head pivots, to engage and disengage the catch. By applying a second rotational movement to the handle in the second orientation, wherein the second rotational movement causes a second torque to be exerted on the handle head, and wherein the second torque is greater than the first torque.

BRIEF DESCRIPTION OF THE DRAWINGS

The exemplary embodiments of the present invention will be described in conjunction with the appended drawing figures in which like numerals denote like elements and.

DETAILED DESCRIPTION

The present invention may be described herein in terms of various functional components. It should be appreciated that such functional components may be realized by any number of hardware components, electrical, mechanical, gravitational, magnetic, and the like configured to perform the specified functions. In addition, the present invention may be practiced in any number of firebox and/or heating system contexts and the firebox systems and methods described herein are merely exemplary applications of the invention. Further, it should be noted that the present invention may employ any number of conventional techniques for closing and/or sealing a fireplace door, and such general techniques that may be known to those skilled in the art are not described in detail herein.

In various exemplary embodiments, a door latch system may comprise a handle, a handle head, and a self-adjusting catch. The handle may removably couple to the handle head. The handle head may be configured to operatively couple to the self-adjusting catch when the handle head is operated by the handle. The door latch system may be installed on a fireplace comprising a door which is configured to enclose a firebox. The door may be configured with a seal which is installed in or integrally formed with the door. As such, when operatively coupled to one another, the handle head and self-adjusting catch may be configured to compress the seal of the door to substantially seal the firebox.

In an exemplary embodiment, the door latch system may be used in connection with a fireplace, a wood stove, a pellet stove, or similar heating system. Although discussed herein in the context of heating systems and more specifically fireplaces, it should be understood that door latch system may be employed with any system that makes use of a door configured with a seal, wherein the seal is compressed against a surface to adequately seal an opening covered by the door. For example, door latch system 100 may be used in connection with any heating system, including, for example an oven, or an autoclave, or any other household or industrial appliance, including for example, a refrigerator, a microwave, a freezer, and the like.

Figure 1:
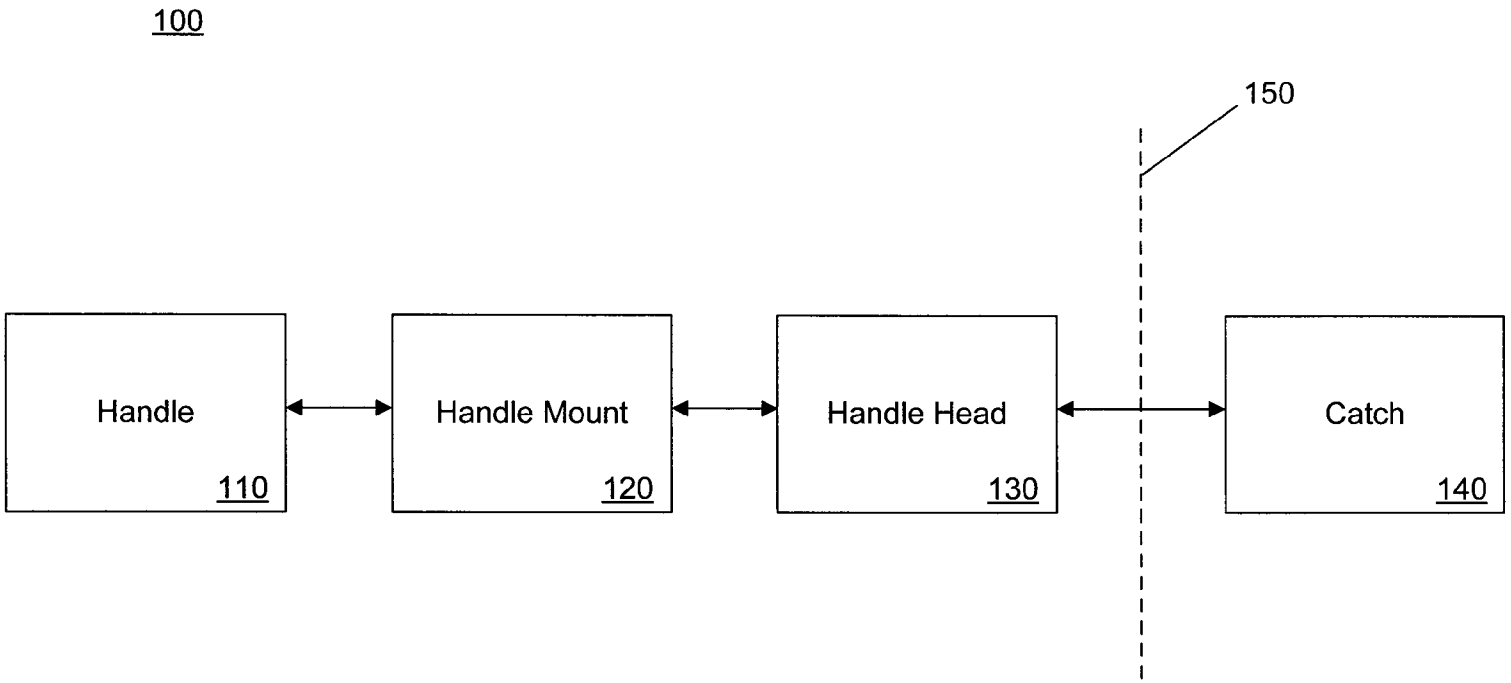
FIG. 1 illustrates a block diagram of an exemplary embodiment showing a various components of a door latch system.

In an exemplary embodiment and with reference to FIG. 1, an exemplary door latch system 100 may comprise a handle 110, a handle mount 120, a handle head 130, and a catch 140. Handle 110 may be configured to removably engage handle mount 120, such that handle 110 is removably coupled to handle mount 120. For example, handle 110 may slidably engage, be clamped, screwed, retain on, removably locked, our otherwise adjustably coupled to handle mount 120, Handle head 130 may couple to handle mount 120 and/or handle 110, such that handle 110 may engage handle head 120 and then be removed and relocated to engage handle head 120. Handle head 130 may also be configured to engage catch 140. Catch 140 may be mounted to a fireplace at any point suitable for engaging handle head 130.

In an exemplary embodiment, as discussed above, handle 110, handle mount 120, and handle head 130 may be provided as an assembly. In an exemplary embodiment, handle mount 120 and handle head 130 may be integrally formed as a single piece such that handle 120 couples directly with handle head 130.

As discussed above, handle 110 may be removable from handle mount 120 and/or handle head 130. Where door latch system 100 is employed in a system that is capable of conducted thermal energy to handle 110, such as, where door latch system 100 is used in connection with a fireplace, handle 110 may be removed and stored away from the system. This allows the handle to be maintained at an ambient temperature, and allows the handle to be used and reduces the risk of being burned.

Figure 2A:
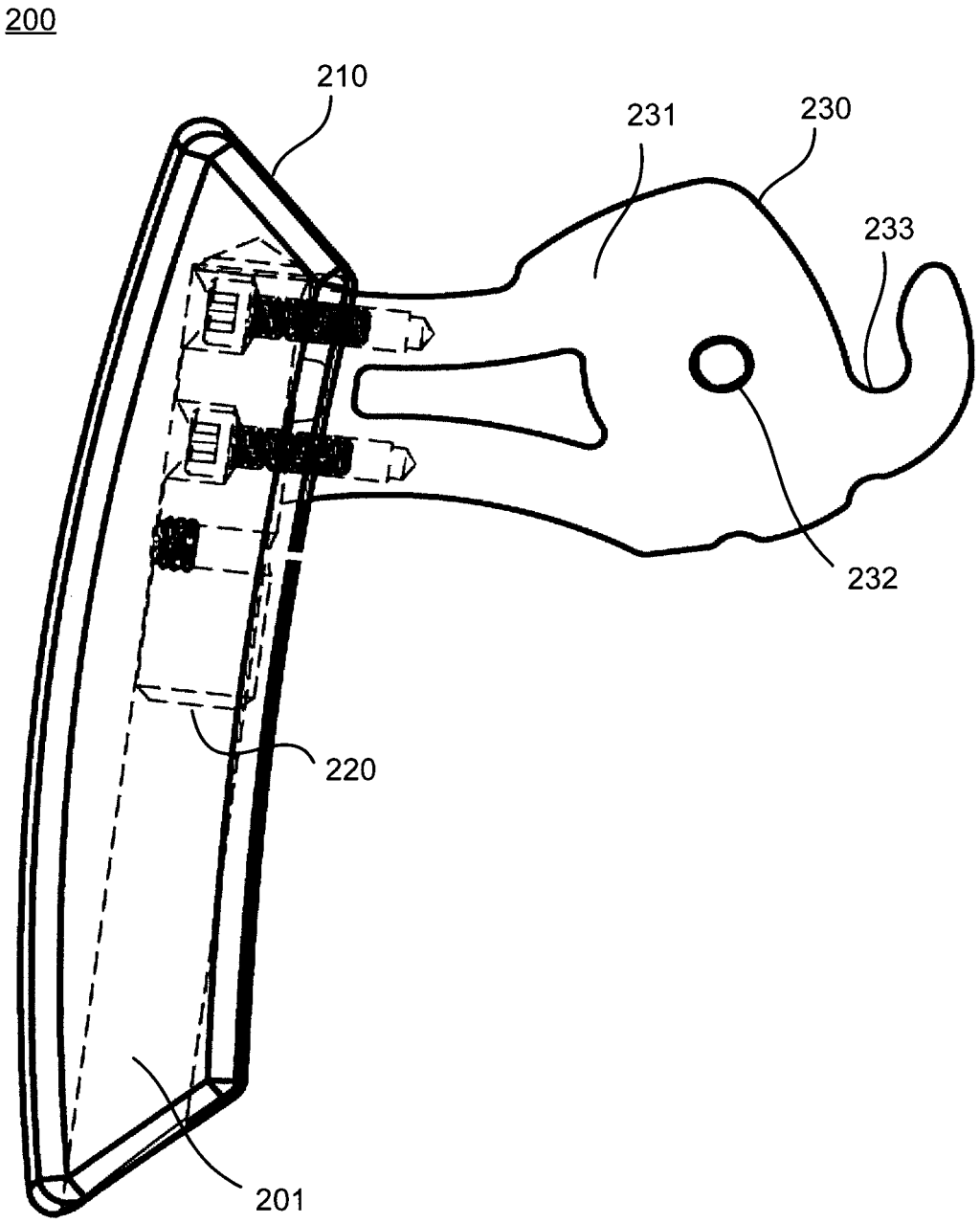
FIG. 2A illustrates an exemplary embodiment showing a profile view of a door handle, handle mount, and handle head assembly.

In an exemplary embodiment and with reference to FIG. 2A, door latch system 200 comprises a handle 210, a handle mount 220, and a handle head 230. In this embodiment, handle 210 slidably engages and removably couples to handle mount 220 in a relatively quick and easy manner. Handle mount 220 may be coupled to handle head 230. Handle mount 220 and handle head 230 may be an assembly coupled together with any suitable mechanism, including for example, a mechanical fastener, an adhesive, welding, brazing, and/or the like. Handle mount 220 and handle head 230 may also be formed as a single integral piece.

Figure 2B:
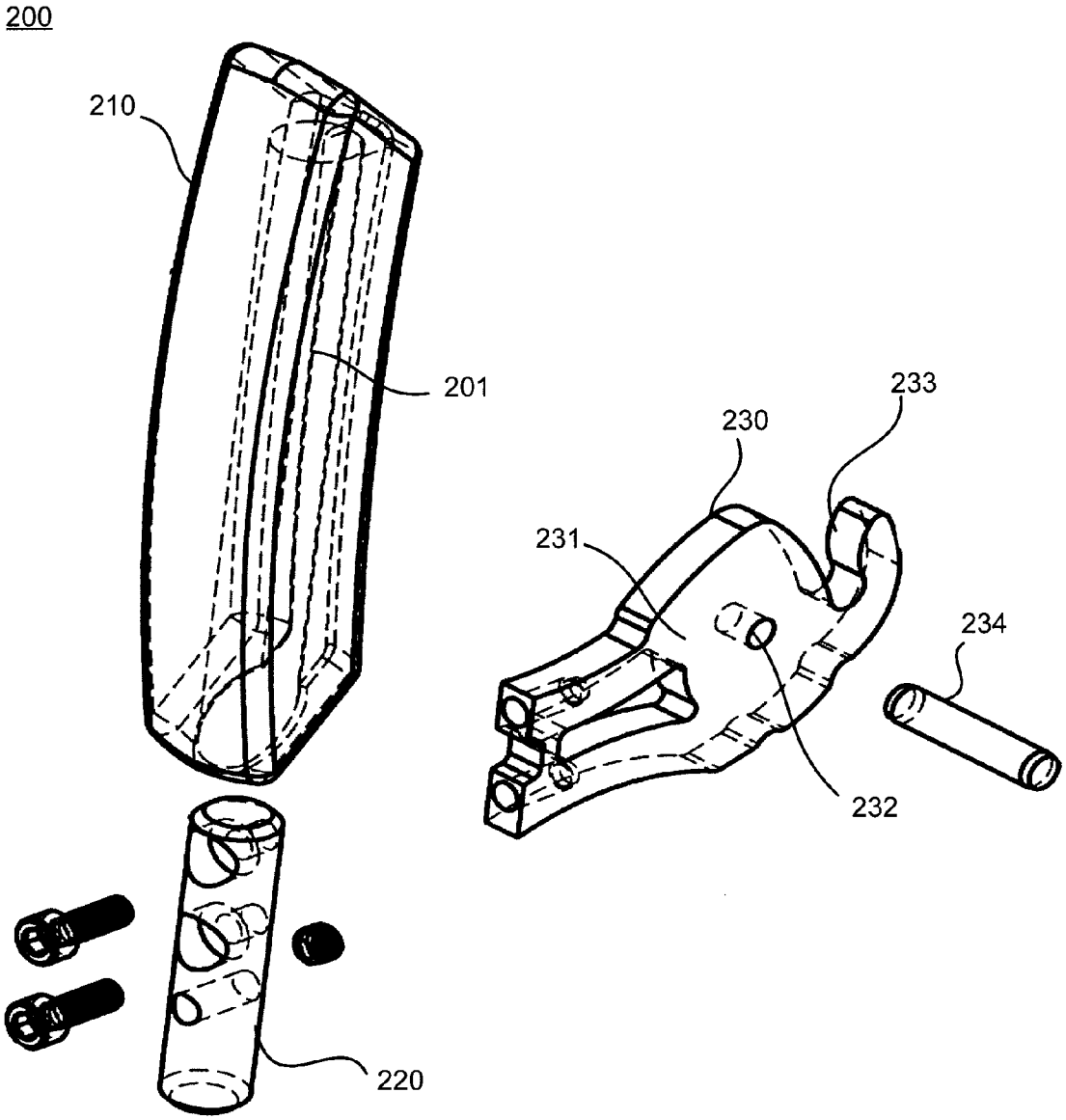
FIG. 2B illustrates an exemplary embodiment showing an exploded view of a door handle, handle mount, and handle head assembly.

In another exemplary embodiment and with reference to FIG. 2B, handle 210 may be configured with a slot 201. Slot 201 may be any shape suitable for coupling to handle mount 220. In an exemplary embodiment, slot 201 defines a cylindrical cavity in handle 210. The cavity may have an open channel. The cavity may be configured with an open end and a closed end.

In an exemplary embodiment, handle 210 may be made of any material suitable for resisting torsion stress and/or thermal stress. For example, handle 210 may be made of cast iron, steel, aluminum, a composite material, a plastic material, and/or any other suitable material.

In an exemplary embodiment, handle 110 may be configured to pivot and cause handle head 130 to engage and/or disengage catch 140. Catch 140 may be configured with a tension adjustment system. As such, when handle head 130 engages catch 140, catch 140 exerts a tension force on handle head 130. For example, with momentary reference to FIGS. 5A and 5D, handle 510 may be configured to engage handle mount 520 and exert a torsion force on handle head 530, which is translated through handle mount 520, where handle 510 is subjected to a rotational movement.

In an exemplary embodiment, handle 210 may be any apparatus suitable for exerting a torque about a pivot point. Handle 210 may have any shape suitable for engagement by a user. For example, handle 210 may have a contoured outer surface. Handle 210 may also be configured with finger grips. Handle 210 may have an ergonomic shape.

In an exemplary embodiment and with reference to FIGS. 2A and 2B, handle mount 220 may be any apparatus suitable for translating a torque from handle 210 to handle head 230. Handle mount 220 may be any shape suitable for providing a coupling point for handle 210 at slot 201. Handle mount 220 may be any shape which provides for an interference fit with handle 210 at slot 201 when handle 210 is subject to a rotational movement and allows for handle 210 to be slidably removable from handle mount 220 when handle 210 is subject to a linear movement. Handle mount 220 may have any shape suitable for removably coupling with handle 210, including for example, a cylindrical shape, as shown in FIGS. 5B, 5C, and 5D. However, in various exemplary embodiments, handle mount 220 may have a square shape, an oval shape, an octagonal shape, or any other suitable shape.

In an exemplary embodiment, handle mount 220 may be made of any material suitable for resisting torsion stress, wear stress, and thermal stress. For example, handle mount 220 may be made of cast iron, steel, aluminum, a composite material, a plastic material, and/or any other suitable material.

In an exemplary embodiment and with continued reference to FIGS. 2A and 2B, handle head 230 may be any apparatus suitable for engaging a catch. Handle head 230 may comprise a body 231, a pivot point 232, and an engagement mechanism 233. Handle head 230 may be configured to pivot about pivot pin 234 at pivot point 232 in response to a rotational movement of handle 210. Moreover, handle head 230 may be configured to engage a catch at engagement mechanism 233.

In an exemplary embodiment, engagement mechanism 233 may be any mechanism suitable for engaging a catch. For example, engagement mechanism may have a "C" or "U" shape that is configured to removably engage the engagement member of a catch. Moreover, engagement mechanism 233 may be configured with a mechanism, such as for example, a spring and detent, a spring loaded bar, and/or the like, to engage the engagement member of a catch.

In an exemplary embodiment, handle head 230 may be made of any material suitable for resisting torsion stress, wear stress, and/or thermal stress. For example, handle head 230 may be made of cast iron, steel, aluminum, a composite material, a plastic material, and/or any other suitable material.

In an exemplary embodiment and with reference to FIGS. 3A, 3B, 3C and 3D, catch 340 may be any mechanism suitable for exerting a force on handle head 330. Catch 340 may comprise an engagement member 341, a tensioning mechanism 342, and a body 343. Engagement member 341 may be retained within body 343. Moreover, one or more tensioning mechanisms 342 may be configured to engage body 343, such that catch 340 is coupled to fireplace 350.

In an exemplary embodiment, engagement member 341 may be any mechanism suitable for engagement with handle head 330. Engagement member 341 may be configured to conduct a tension force from tensioning mechanism 342 to handle head 330. In an exemplary embodiment, engagement mechanism 341 is a shaft. The shaft may be of any shape, including for example, a circular shape, square shape, an oval shape, an octagonal shape, or any other suitable shape.

In an exemplary embodiment, engagement member 341 may be made of any material suitable for resisting torsion stress, wear stress, and/or thermal stress. For example, engagement member 341 may be made of cast iron, steel, aluminum, a composite material, a plastic material, and/or any other suitable material.

In an exemplary embodiment and with reference to FIGS. 3A, 3B, 3C and 3D, tensioning mechanism 342 may be any mechanism suitable for exerting a tension force in response to handle head 330 engaging engagement member 341. Tensioning system 342 may comprise a support 345 and a tensioner 346. Support 345 may slidably couple with and support tensioner 346.

In an exemplary embodiment, support 345 may be any structure suitable for coupling with and supporting tensioner 346. Support 345 may be a shaft, fastener, including for example a screw, a bolt, and/or the like. Tensioner 346 may be any device configured to create a tension force at engagement member 341. For example, tensioner 346 may be a compression spring, a bushing, or any other suitable device for creating a tension force at engagement member 341. More specifically, tensioner 346 may be configured to create the tension force in response to catch 340 being engaged by handle head 330.

Figure 3A:
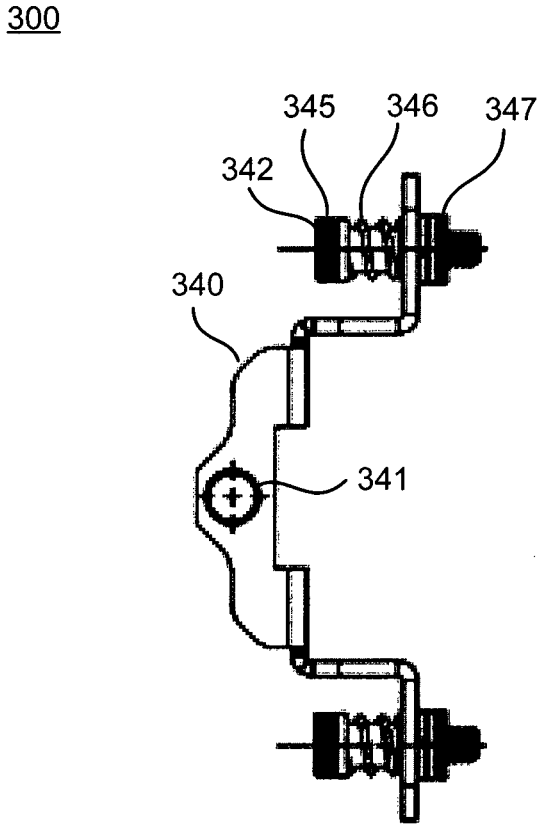
FIG. 3A illustrates an exemplary embodiment showing a profile view of a catch.
Figure 3B:
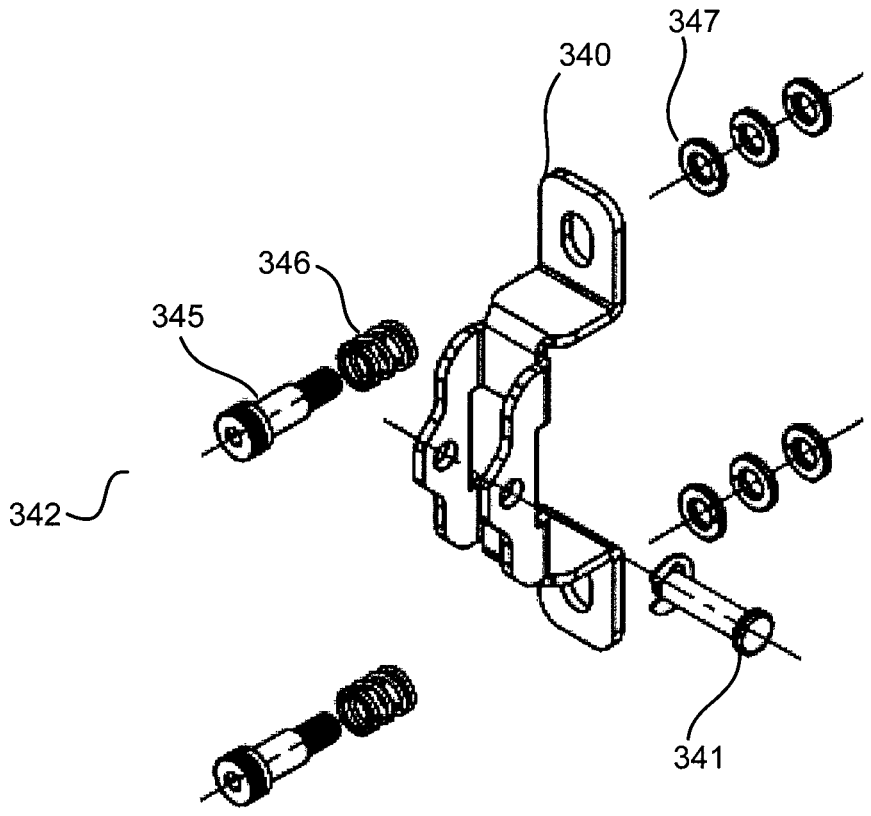
FIG. 3B illustrates an exemplary embodiment showing an exploded view of a catch.
Figure 3C:
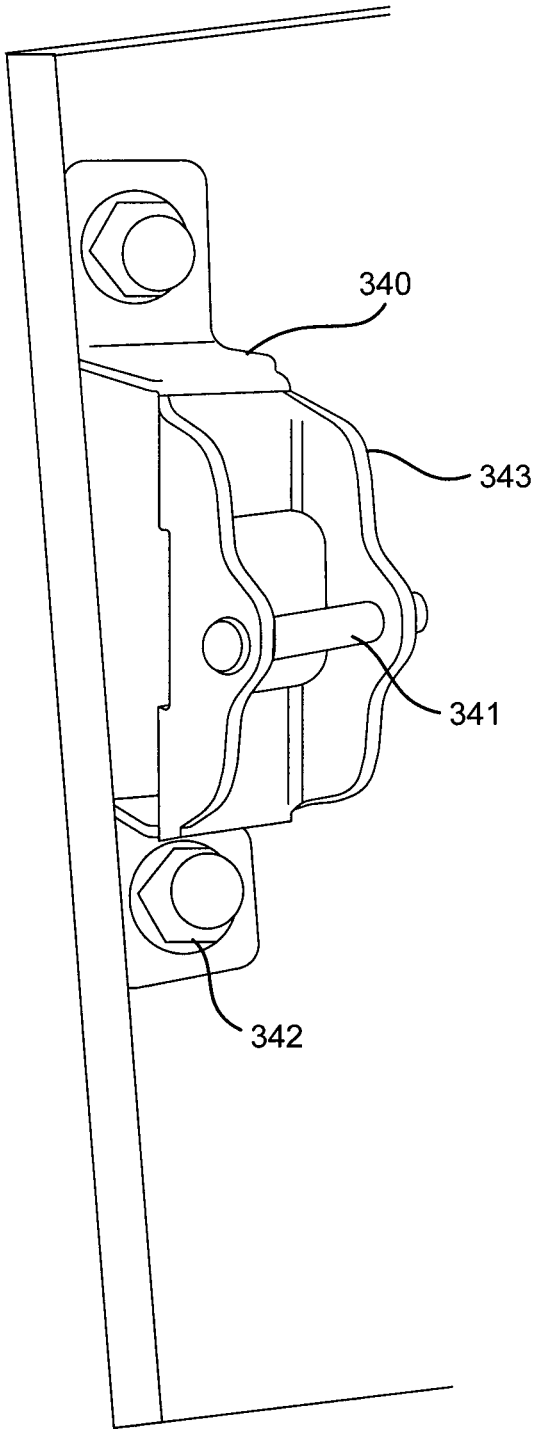
FIG. 3C illustrates an exemplary embodiment showing a perspective view of a catch installed on a fireplace.
Figure 3D:
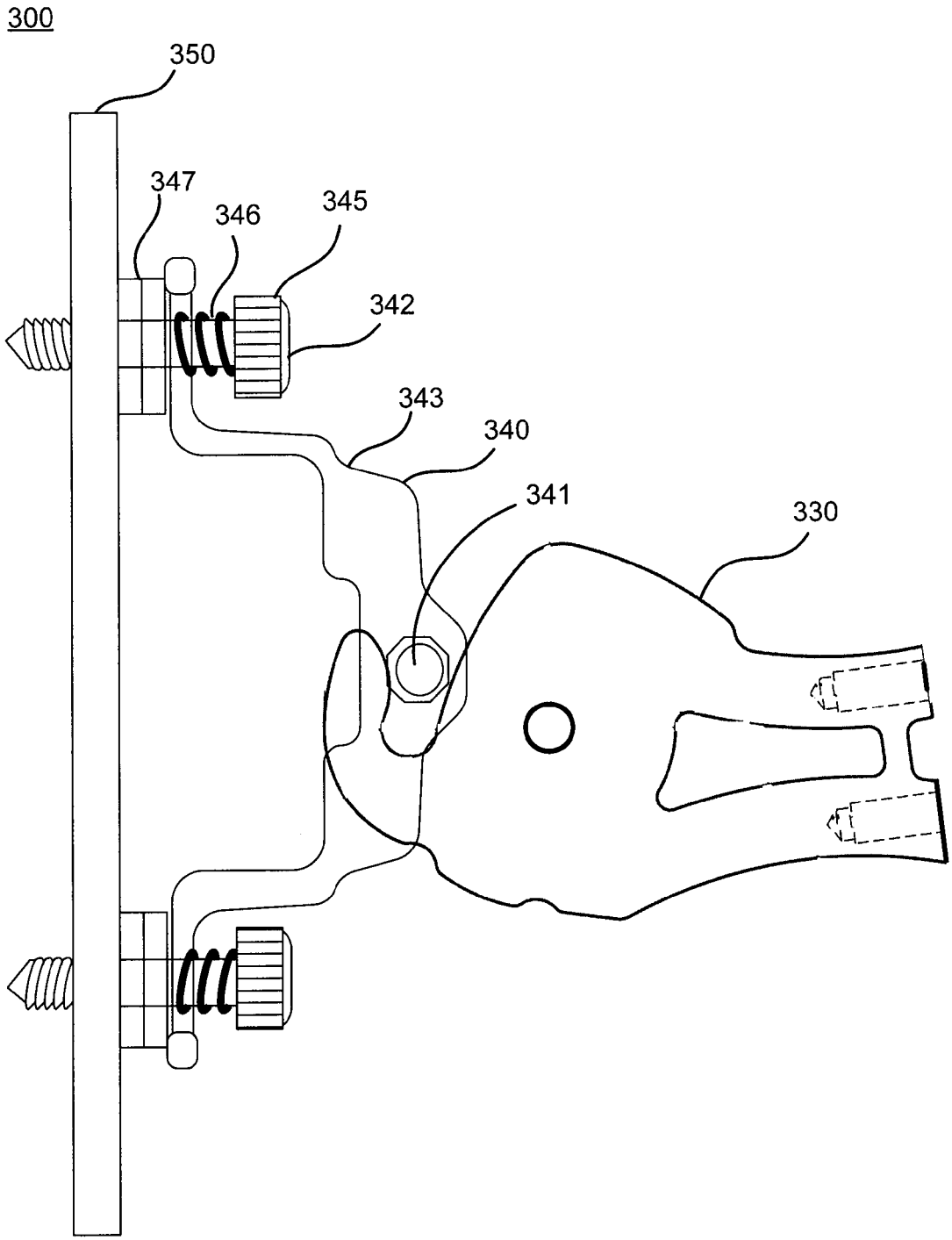
FIG. 3D illustrates an exemplary embodiment showing a profile view of a handle head and catch assembly.
Figure 4:
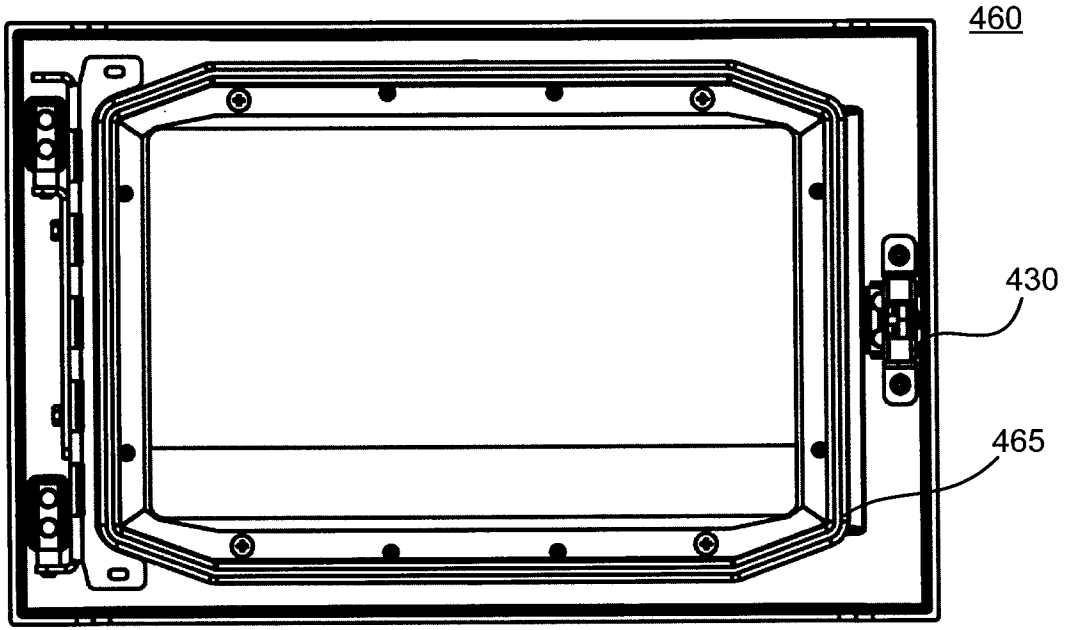
FIG. 4 illustrates an exemplary embodiment showing a view of a fireplace door having a seal.

With reference to FIG. 3D and FIG. 4, tensioning system 342 may further comprise one of more spacers 347. Spacer 347 may be any mechanism that is suitable configured to control the travel of tensioner 346 and/or adjust the length of support 345. In one embodiment, spacer 347 may be a washer or ring. Spacer 347 may be installed or retained on support 345. Spacer 347 may be installed on the "catch side" of fireplace 350, as shown in FIGS. 3B and 3D and/or may be installed on the "seal side" of fireplace 350 (e.g. fireplace 450), as shown in FIG. 4. Moreover, one or more spacers 347 may be installed on support 345. In operation, one of more spacers 347 may be added or removed from support 345. The addition or removal of one or more spacers 347 may cause the tension force of tensioner 346 to increase or decrease. Moreover, where spacer 347 is installed on the "seal side" of fireplace 350, one of more spacers 347 may be added or removed to adjust the compression force exerted on seal 465. Overtime, it may be necessary to adjust the compression force exerted on seal 465 to insure a proper and efficient seal of a firebox. For example, seal 465 may wear causing thermal energy to leak around the seal. This leaking may impact the operational efficiency of the fireplace.

In an exemplary embodiment and with reference again to FIGS. 3A, 3B, 3C and 3D, catch 340 may be self adjusting. Where tensioning system 342 exerts a tension force at engagement member 341 in response to an engagement with handle head 330, the tension force created by tensioner 346 adjusts catch 340 to ensure a secure engagement with handle head 330.

In an exemplary embodiment and with reference to FIG. 4, handle head 430 may be installed in a fireplace door 460. Handle head 430 may be attached to an exterior surface of fireplace door 460. Handle head 430 may also be attached through a portion of fireplace door 460. Moreover, handle head 430 may be attached to fireplace door 460 at any point suitable, such that handle head 430 is able to engage catch 340, as shown in FIGS. 3A and 3B.

In an exemplary embodiment and with continued reference to FIG. 4, fireplace door 460 may comprise a door seal 465. Door seal 465 may be any suitable material configured to engage a fireplace and seal the firebox around the firebox opening covered by the fireplace door 460. Moreover, the tension force provided by catch 340, as shown in FIGS. 3A and 3B, on handle head 430 causes seal 465 to compress to the fireplace.

Figure 5A:
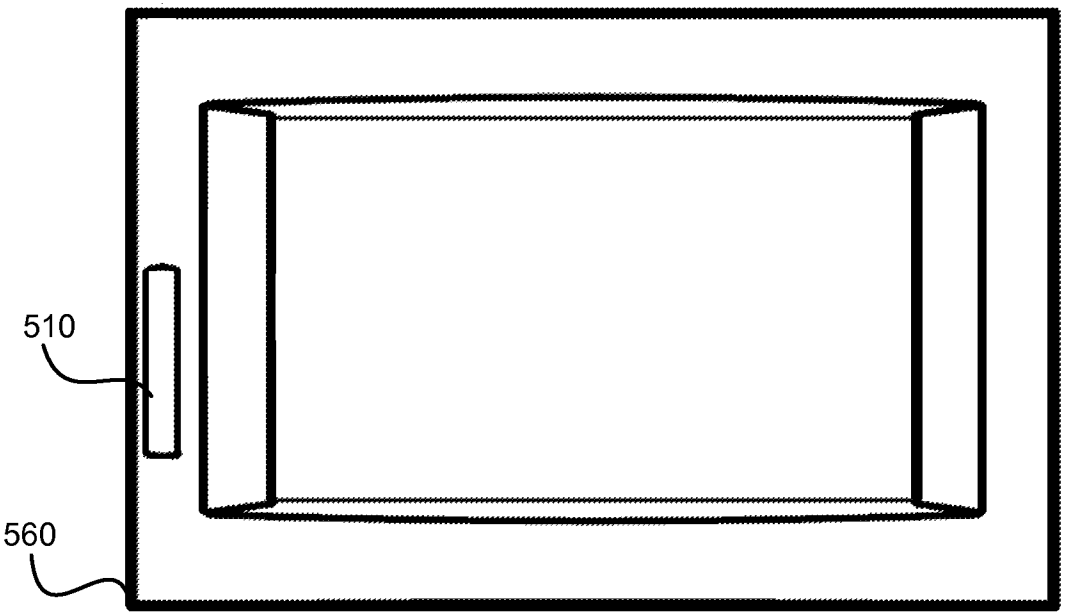
FIG. 5A illustrates an exemplary embodiment of the showing a view of a fireplace with a door latch system with a handle coupled to the handle mount in a first orientation.
Figure 5B:
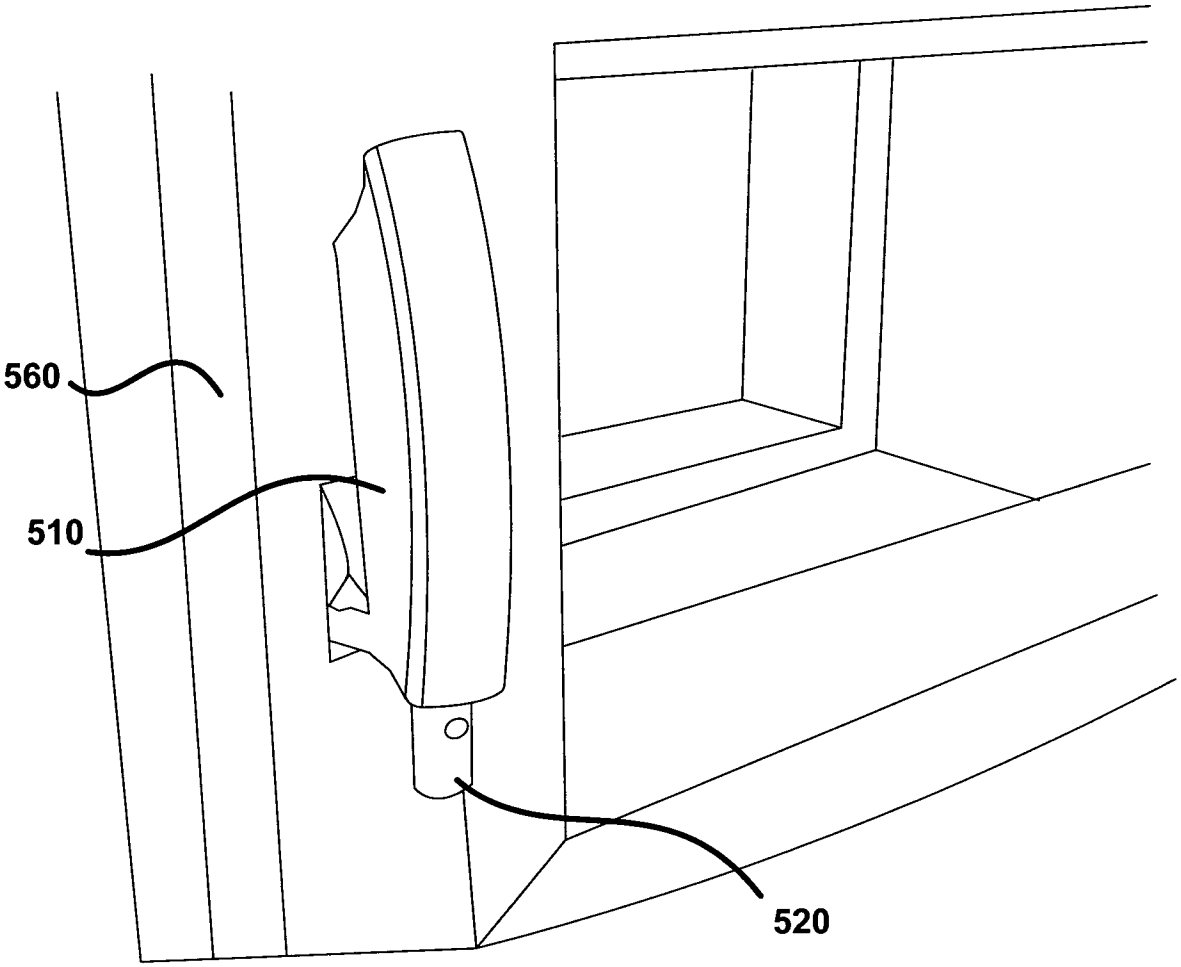
FIG. 5B illustrates an exemplary embodiment of the showing a view of a fireplace with a door latch system with a handle partially coupled to the handle mount in a first orientation.
Figure 5C:
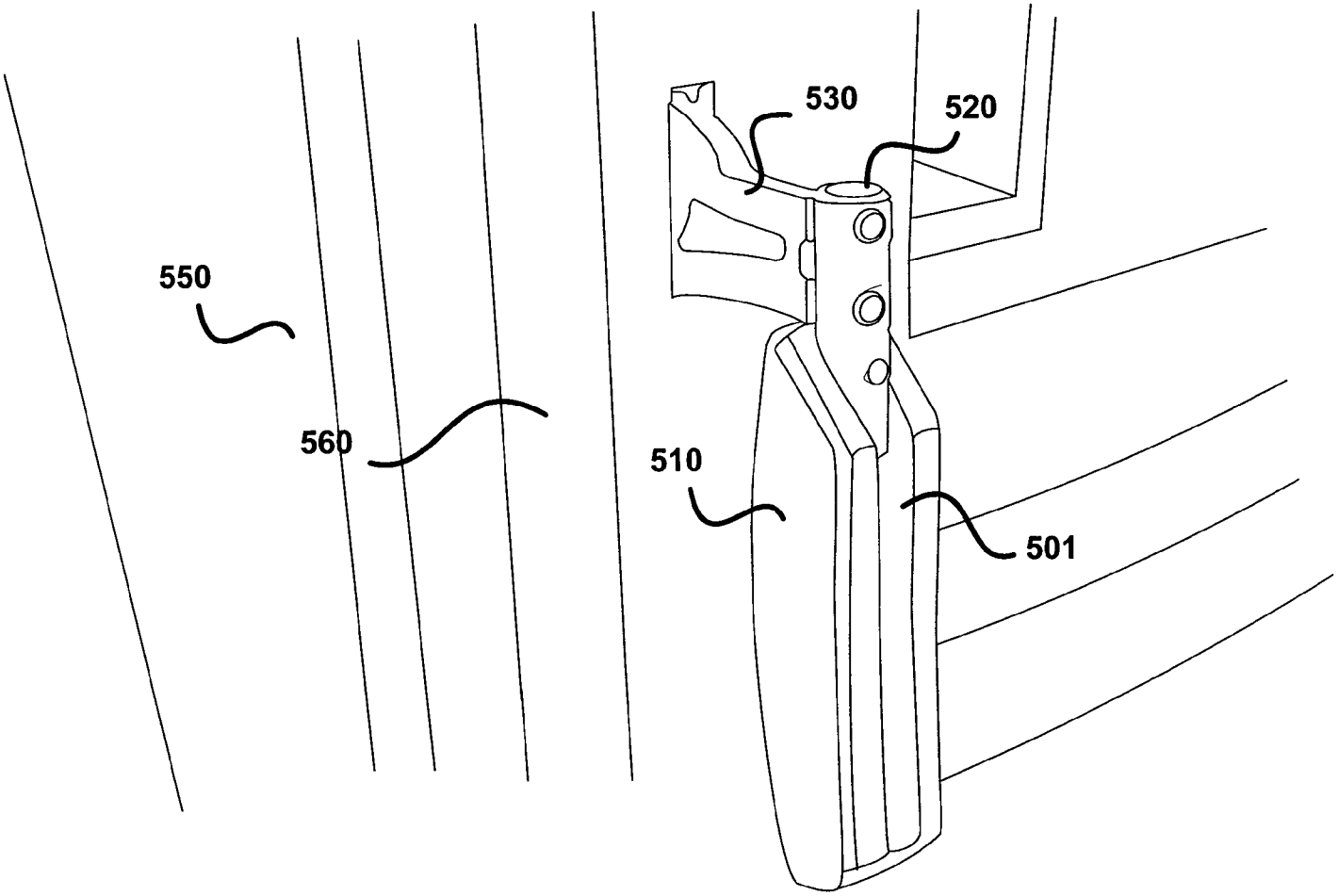
FIG. 5C illustrates an exemplary embodiment of the showing a view of a fireplace with a door latch system with a handle coupled to the handle mount in a second orientation.
Figure 5D:
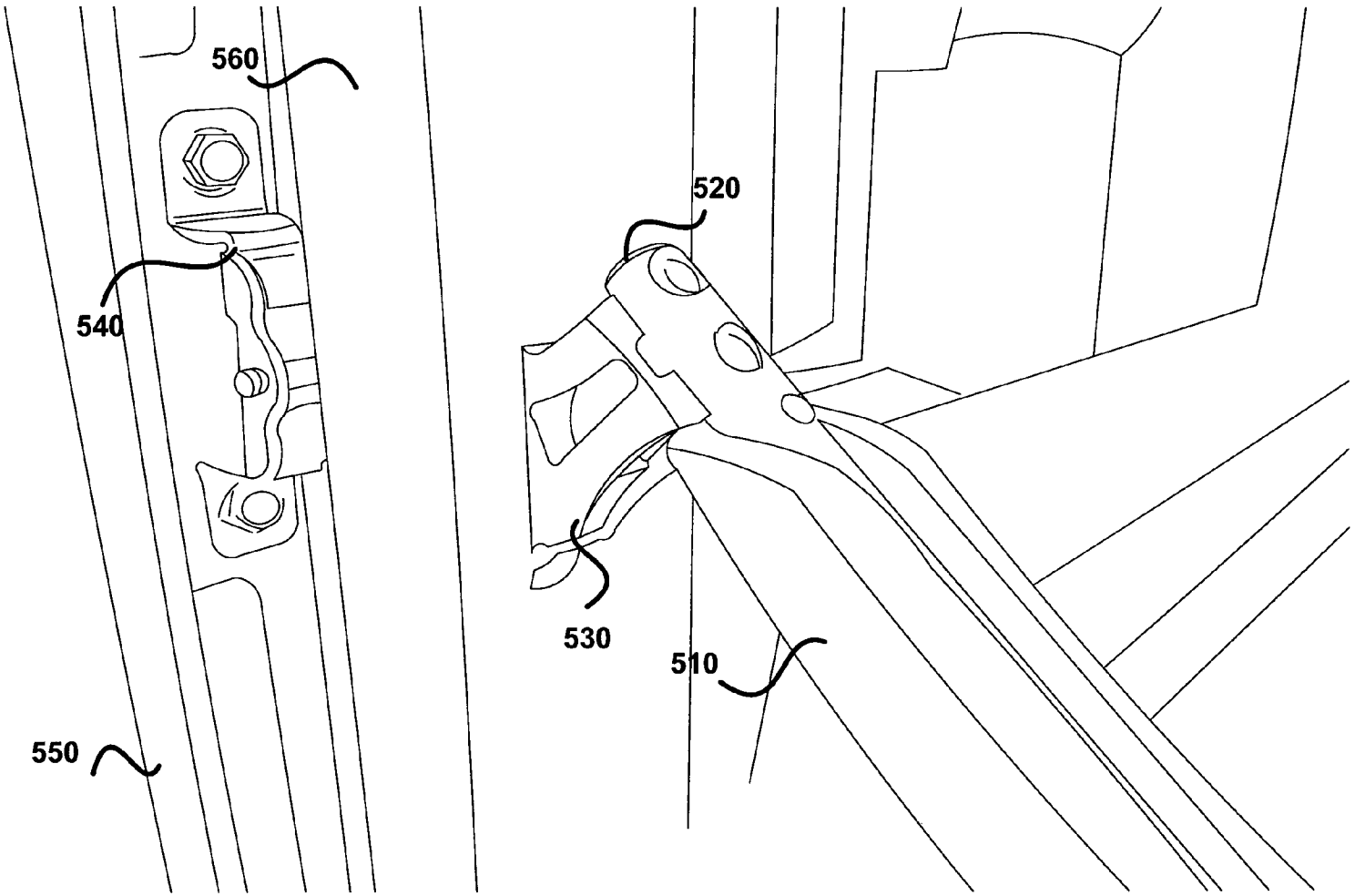
FIG. 5D illustrates an exemplary embodiment of the showing a view of a fireplace with a door latch system with a handle coupled to the handle mount in a second orientation.

In an exemplary embodiment and with reference to FIGS. 5A and 5B as well as 5C, in a first orientation, handle 510 may slidably couple to a first end of mount 520 in slot 501 such that mount 520 abuts the closed end of slot 501. In an exemplary embodiment and with reference to FIGS. 5C and 5D, in a second orientation, handle 510 may also slidably engage a second end of mount 520 at the open end of slot 501. The second orientation creates a longer lever arm with handle 510. As such, a user actuating handle head 530 is able to provide a greater torque to handle head 530 about pivot point 232 (as shown in FIGS. 2A and 2B). The ability to provide a greater torque also allows the user to ensure that fireplace door 560 is securely sealed around the firebox, and that handle head 530 is securely engaged to catch 560.

In various exemplary embodiments, the door latch systems described herein may be employed with various fireplaces, wood stoves, heating systems, and others systems, having, fireboxes, housings, and various other components such as louvers, vents, and the like.

The various exemplary embodiments described herein, set forth exemplary door latch systems and methods, which are applicable to various heating system applications. It will be understood that the foregoing description is of exemplary embodiments of the invention, and that the invention is not limited to the specific forms shown. Various modifications may be made in the design and arrangement of the elements set forth herein without departing from the scope of the invention. For example, the location of components to match the heating system design, the different types of solid fuel applications, and the standalone aspect of the system and method can be suitably modified, adjusted, and/or re-configured. These and other changes or modifications are intended to be included within the scope of the present invention.

When a phrase similar to "at least one of A, B, or C" or "at least one of A, B, and C" is used in the claims or specification, Applicants intend the phrase to mean any of the following: (1)

at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "includes," "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

We claim:

1. A door latch system, comprising:

a handle head;

a handle mount coupled to the handle head, wherein the handle mount comprises a first end and a second end opposite the first end;

a handle configured to removably couple to the handle mount, wherein the handle is configured to slidably engage the handle mount at the first end to produce a first orientation and at the second end to produce a second orientation, and wherein a torque resulting from a rotational movement of the handle is translated through the handle mount to the handle head; and a catch comprising a tensioner mechanism, wherein the handle head is configured to engage the catch, and wherein the tensioner mechanism is configured to conduct a tension force from the catch to the handle head.

2. The door latch system of claim 1, wherein the handle, in the first orientation, is configured to engage the handle mount, such that the handle is retained on the handle mount by at least a portion of a weight of the handle.

3. The door latch system of claim 1, wherein the handle, in the second orientation, is configured to exert a second torsion force on the handle head which is greater than a first torsion force, where the handle is in the first orientation.

4. The door latch system of claim 1, wherein the handle has a curved outer surface.

5. The door latch system of claim 1, wherein the door latch system is coupled to an appliance.

6. The door latch system of claim 5, wherein the appliance is at least one of a heating system, a freezer, and a refrigerator.

7. The door latch system of claim 1, wherein the tensioner mechanism comprises a spring.

8. The door latch system of claim 1, wherein the tensioner mechanism comprises a flexible bushing.

9. A fireplace, comprising;

a door;

an engagement comprising a handle mount having a first end and a second end opposite the first end;

a handle removably coupled to the handle mount, wherein the handle may be slidably coupled to the handle mount at the first end to produce a first orientation and at the second end to produce a second orientation;

a catch mechanism coupled to the door, the catch mechanism comprising a first tensioner and a first tensioner adjustment mechanism;

wherein the engagement is configured to operatively engage the catch mechanism in response to a first torque applied to the handle in the first orientation; and wherein the engagement is configured to operatively engage the catch mechanism in response to a second torque applied to the handle in the second orientation.

10. The fireplace of claim 9, further comprising;

a housing configured to operatively couple to the catch mechanism;

a door rotatably coupled to the housing;

a firebox partially enclosed within the housing and substantially sealable by the door.

11. The fireplace of claim 10, wherein the firebox is sealed by the door in response to at least one of the first torque and the second torque.

12. The fireplace of claim 9, wherein the tensioner is a spring.

13. The fireplace of claim 12, further comprising a spacer associated with the tensioner, wherein the spacer may be at least one of removed and added to adjust a tension force associated with the tensioner.

14. The fireplace of claim 9, wherein the engagement has at least one of a C shape and a U shape.

15. The fireplace of claim 9, wherein the tensioner has a first spring force and wherein at least a portion of the first spring force is applied tangentially to the engagement in response to at least one of the first torque and the second torque.

16. A method for closing a fireplace door to a fireplace, comprising:

providing the fireplace door comprising a door seal and a door latch system, wherein the door latch system comprises a removable handle coupled to a handle mount, and wherein the handle mount comprises a first end and a second end opposite the first end;

providing a fireplace comprising a self-tensioning catch;

coupling the handle at the first end of the handle mount to produce a first orientation;

applying a first rotational movement to the handle in the first orientation, wherein the rotational movement causes a first torque to be exerted on the handle head, and wherein in response to the torque the handle head pivots to at least one of engage and disengage the catch;

coupling the handle at the second end of the handle mount to produce a second orientation;

applying a second rotational movement to the handle in the second orientation, wherein the second rotational movement causes a second torque to be exerted on the handle head, and wherein the second torque is greater than the first torque.

17. The method of claim 16, wherein the self-tensioning catch comprises a spring having a first spring force.

18. The method of claim 17, wherein the self-tensioning catch further comprises a spacer, and wherein at least one of an addition of the spacer and a removal of the spacer changes the first spring force.

19. The method of claim 16, wherein the handle is removable to reduce a thermal stress of the handle.

* * * * *